United States Patent [19]

Price

[11] Patent Number: 4,491,997

[45] Date of Patent: Jan. 8, 1985

[54] MACHINE FOR LASTING HEEL SEAT PORTIONS OF SHOES

[75] Inventor: Frank C. Price, Leicester, England

[73] Assignee: USM Corporation, Farmington, Conn.

[21] Appl. No.: 477,313

[22] Filed: Mar. 21, 1983

[51] Int. Cl.[3] ..... A43D 21/00

[52] U.S. Cl. ..... 12/12.1; 12/12.5; 12/13.1

[58] Field of Search ..... 12/8.7, 8.8, 10.2, 10.3, 12/10.5, 12.4, 12.5, 13.1, 14.4

[56] References Cited

U.S. PATENT DOCUMENTS

| | | | |
|---|---|---|---|
| 3,087,176 | 4/1963 | Deschenes | 12/12.5 |
| 3,444,571 | 5/1969 | Harriman et al. | 12/12.5 |
| 4,322,863 | 4/1982 | Giebel | 12/12.5 |
| 4,360,938 | 11/1982 | Murphy et al. | 12/12.5 |

FOREIGN PATENT DOCUMENTS

| | | | |
|---|---|---|---|
| 2052950 | 2/1981 | United Kingdom | 12/12.5 |

*Primary Examiner*—Henry S. Jaudon
*Assistant Examiner*—Steven N. Meyers
*Attorney, Agent, or Firm*—Donald N. Halgren

[57] ABSTRACT

In a tack seat lasting machine the wiper plates (90) first effect an "advancing+inwiping" movement and thereafter an "inwiping only" movement, while a central wiping member (76), about which the wiper plates pivot, advances only. To achieve this motion, the member (76) is supported by an arcuate projection (78) which is accommodated in grooves (83) formed in the wiper carriers (88), the center of curvature of the projection and grooves coinciding with the axis of the wiper plates. Thus, the central wiping member is always brought to the same "back tack" position (but the shoe can be adjustably positioned relative thereto by varying the fore-and-aft position of the heel band (20)). The nail pattern is adjustable, without affecting the back tack position, by limiting the stroke of the cylinder controlling the operation of the wiper assembly.

9 Claims, 2 Drawing Figures

170
72
79
170
77
75
161
145
71
147
96
85
151
70
85
149
153
71
94
94
174
155
177
177
94
174
94
83
83
81
120
78
172
88
92
90
90
172
71
88
92
155
76
157
159

MACHINE FOR LASTING HEEL SEAT PORTIONS OF SHOES

BACKGROUND OF THE INVENTION (1) Field of the Invention

This invention is concerned with machines for lasting heel seat portions of shoes.

(2) Prior Art

Heel seat lasting machines may comprise a shoe support for supporting, bottom uppermost, a shoe comprising an upper positioning on a last and an insole on the last bottom, a wiper assembly comprising a central wiping member, carried by a support therefor, and two wiper plates, each carried by a wiper carrier, said member being fixed against rotation, while said carriers are mounted for pivotal movement, each about an axis which lies within the confines of the central wiping member, the member and plates presenting a substantially continuous leading edge portion whereby lasting marginal portions of the upper of a shoe supported by the shoe support can be wiped over and pressed against corresponding marginal portions of the insole of such shoe, and fastener-inserting means, associated with the wiper assembly, whereby fasteners can be driven, through a series of apertures formed in the wiping member and wiper plates, adjacent the leading edge portion presented thereby, for securing said wiped-over lasting marginal portions of the upper to the corresponding marginal portions of the insole, two such apertures being disposed side-by-side in the central wiping member, and the fasteners driven through said apertures being the most heelwardly disposed of the fasteners inserted by the fastener-inserting means, wherein advancing means is provided whereby the support for the central wiping member and the wiper carriers can be advanced towards the shoe support, cam means also being provided whereby pivotal movement of the wiper carriers can be effected in response to operation of the advancing means, the position to which the central wiping member is advanced as aforesaid determining the location of insertion of the most heelwardly disposed fastener(s), while the amount of pivotal movement of the wiper carriers, and thus of the wiper plates determines the overall pattern in which the fasteners are inserted.

Such a heel seat lasting machine is described in our U.S. Pat. No. 4,322,863. In this machine, the advancing means is operatively connected to the support for the central wiping member, while the wiper carriers are operatively connected to said support by means of linkage arrangements which, in combination with the cam means, are effective to cause advancing movement only, or advancing and pivotal movement, of the wiper carriers, according to the construction of the cam means, during the operation of the advancing means. It will thus be appreciated that, in the operation of this machine, the pivotal movement of the wiper carriers can only take place while advancing movement of the support for the central wiping member, and thus of the member itself, is taking place.

Thus, in the operation of this machine, where it is desired for example to vary the location in which the two most heelwardly disposed fasteners are to be inserted, the overall pattern in which all the fasteners are inserted is also varied, since such further advancing movement of the central wiping member also affects the amount of pivotal movement of the wiper carriers, and thus of the wiper plates. Conversely, furthermore, if it is desired to vary the overall pattern, then necessarily the location in which the two most heelwardly disposed fasteners are inserted must also be varied, or, in order to prevent such variation of the location, the position of the heel band (which determines the position of the shoe in relation to the wiper assembly) must be correspondingly adjusted.

Whereas in general some degree of tolerance in the aforementioned location is acceptable, in other cases the location of the two most heelwardly disposed fasteners may be considered of significance. On the other hand, the readily adjustable position of the overall pattern of fasteners, which clearly is readily achieved in the operation of the aforementioned machine, is considered to be also desirable.

It is the object of the present invention to provide an improved machine for lasting heel seat portions of shoes, wherein variations of the overall pattern of fasteners to be inserted does not affect the location of the most heelwardly disposed fasteners.

BRIEF SUMMARY OF THE INVENTION

In accordance with the invention, it is provided that, in a machine of the type set out earlier in this specification, the advancing means is operatively connected to the wiper carriers, and each wiper carrier is connected to the support for the central wiping member, for relative sliding movement therebetween, by an arcuate groove-and-projection connection, the center of curvature of which coincides with the axis of said wiper carrier and in that the construction and arrangement of the cam means is such that during a first part of the operation of the advancing means the wiper carriers are advanced towards the shoe support, while in a subsequent part of the operation each carrier merely pivots about its axis.

It will thus be appreciated that, by so interconnecting the wiper carriers and the support for the central wiping member, the latter is caused to advance as long as the movement of the wiper carriers have a forward component, but once the movement of the wiper carriers becomes merely pivotal, further advancing movement of the support for the central wiping member ceases, such movement of the wiper carriers being of course achieved by the cam means. Thus, it will be appreciated that the central wiping member can be brought in each cycle of operation of the machine to a predetermined location in relation to the shoe support, and this is in no way affected by the setting of the overall pattern of fasteners to be inserted, which pattern depends upon the amount of pivotal movement of each wiper carrier about its axis.

The support for the central wiping member and the wiper carriers may, in the first part of the operation of the advancing means, be moved merely bodily linearly, but preferably in said first part the wiper carriers effect some pivotal movement during their advancing movement. To this end, conveniently the cam means comprises for each wiper carrier, two cam face portions with which cam follower rolls co-operate, each face portion comprising a first part, which is generally inclined to the direction of movement of the support for the central wiping member towards the shoe support, and a second part which is arcuate and the center of curvature of which coincides with the axis of the wiper carrier. More especially, preferably the first part of the cam face portion is rectilinear. Conveniently, furthermore, each cam face portion is provided by a slot in a cam plate which is fixedly mounted in a machine, while the cam follower rolls are carried on the wiper carriers.

Conveniently, the arcuate groove-and-projection connection between the wiper carriers and the support for the central wiping member is provided by a groove formed within each wiper carrier for receiving a projection formed integral with said support. Furthermore, preferably the wiper carriers each have a groove formed therein for receiving a projection carried by the support for the central wiping member.

It will be appreciated that from time to time, it will be desirable to alter the setting of the location of insertion of the most heelwardly disposed fastener(s), and to this end, in known manner the machine preferably comprises a heel band whereby the heel seat of the shoe to be operated upon can be held located in relation to the wiper assembly, means being provided for adjusting the position of the heel band lengthwise of the shoe bottom.

In addition, it is also desirable to be able to adjust the overall pattern of fasteners to be inserted in using the machine. To this end, the advancing means may be mechanically operated, mechanical means being provided for limiting the stroke thereof, but preferably, and conveniently, the advancing means is fluid pressure operated, and adjustable stop means is provided whereby the amount of movement of the wiper assembly under the action of said advancing means can be adjusted. By using the adjustable stop means therefore, to limit the stroke of fluid pressure operated advancing means, the amount of pivotal movement of the wiper assembly is curtailed according to the overall pattern required. Of course, it is envisaged that there will always be a minimum amount of movement of the wiper assembly under the action of the fluid pressure operated advancing means so as to ensure that the support for the central wiping member is sufficiently advanced to bring said member to its desired position.

BRIEF DESCRIPTION OF THE DRAWINGS

There now follows a detailed description, to be read with reference to the accompanying drawings, of one machine constructed in accordance with the invention, which machine has been selected for description merely by way of non-limiting example.

In the accompanying drawings.

DESCRIPTION OF THE PREFERRED EMBODIMENTS

Figure 1:
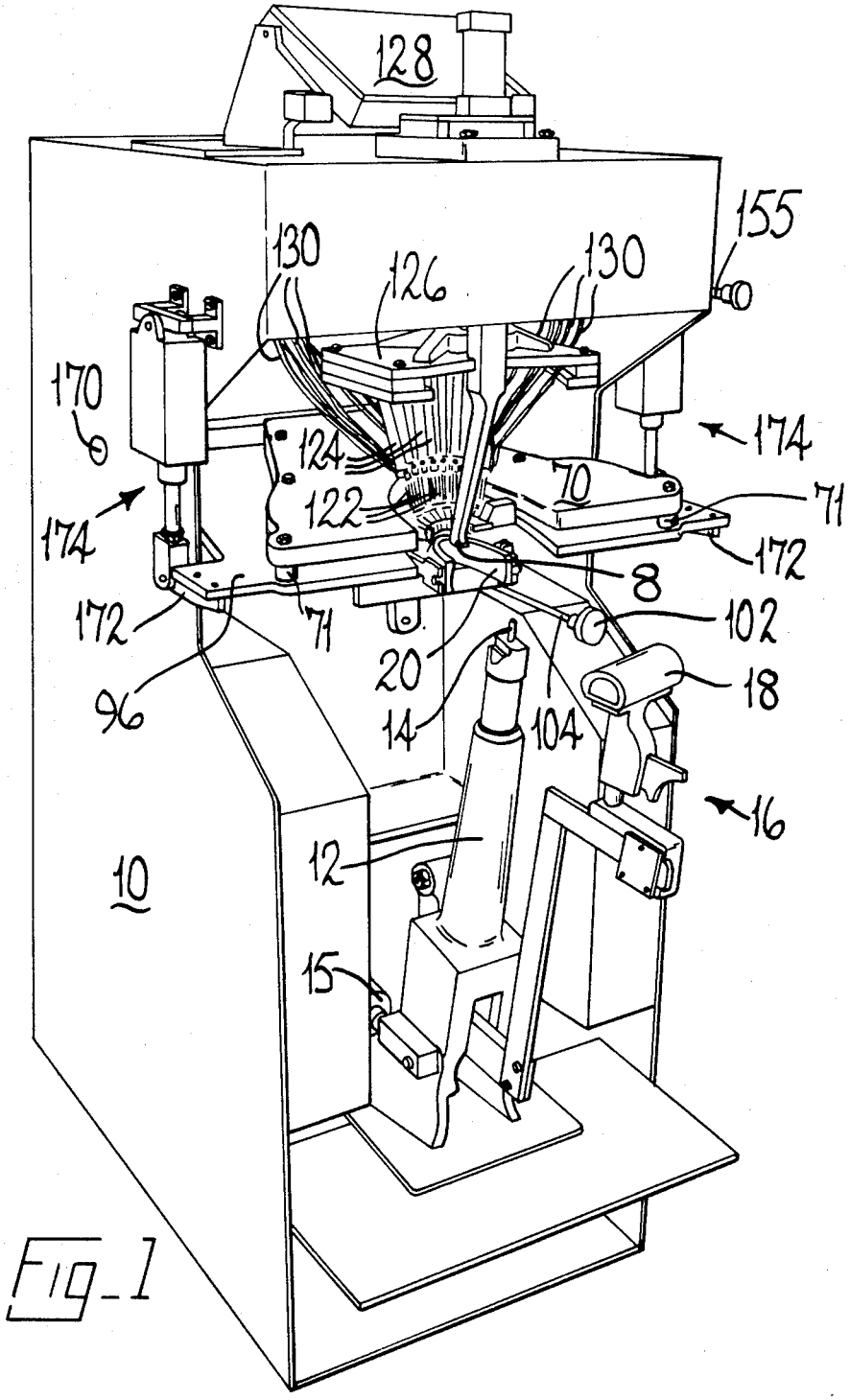
FIG. 1 is a perspective view of the machine in accordance with the invention.

The machine in accordance with the invention is generally similar, except as hereinafter described, to the machine described in our U.S. Pat. No. 4,322,863, herein incorporated by reference. Thus, the machine in accordance with the invention comprises a main frame 10, a shoe support 12 pivotally mounted on the main frame, and supporting a last pin 14 on which a shoe can be supported, bottom uppermost. The shoe support also comprises a toe support arrangement generally designated 16, including a toe pad 18. In addition, the machine comprises a conventional holddown 8 and also a heel band 20 which is supported in the machine frame 10. For pivoting the shoe support 12 between a loading position (as shown in FIG. 1) and an operating position in which the heel part of a shoe is pressed into the heel band 20 and urged upwards against the holddown 8, fluid pressure operated means is provided, comprising a cylinder 15 which is shown in FIG. 1.

The machine in accordance with the invention also includes a wiper assembly comprising a base plate 96 supported, at opposite sides thereof, towards the rear thereof by bearing blocks 170 and towards the front thereof by brackets 172, each bracket 172 being supported by a piston-and-cylinder arrangement designated 174, said arrangements being supported by the frame 10. Mounted on the base plate 96, and secured thereto through spacers 71, is a support casting 70, between which and the base plate 96 is accommodated, for sliding movement lengthwise of the bottom of a shoe supported by the shoe support 12, a plate 75 which is connected by links 85 to two wiper carriers 88, each wiper carrier supporting a wiper plate 90. For moving the plate 75, and thus the wiper plates 90, a piston-and-cylinder arrangement 72 is supported on the underside of the base plate 96, and a piston rod 74 thereof is connected to a block 77 secured to the underside of the plate 75 and projecting downwardly through a slot 79 formed therefor in the base plate 96.

The wiper carriers 88 are each provided with two cam follower rolls 94 which are accommodated in grooves 92 formed in the support casting 70. The axis of the rear roll 94 of each set is coincident with the axis on which the link 85 is secured to the wiper carrier 88.

Each groove 92, though continuous, in constituted by two sections arranged one after the other along its length, and each section comprises a first, rearward, part, which is essentially rectilinear and is inclined to the lengthwise direction of the shoe bottom, e.g. at an angle of approximately 45° to the longitudinal center line of the machine, and a second, forward, part, which is arcuate, the center of curvature thereof coinciding with a pivot axis of the wiper carriers 88, and thus of the plates 90. The effect of the first parts of each section, as the plate 75 is urged forwardly in the machine, is to cause the wiper carriers 88, and thus the wiper plates 90 supported thereby, to be advanced and to pivot inwardly towards a shoe held by the shoe support 12 in its operative position, while the second part of each section is effective to cause pivotal movement only of the wiper plates 90.

In addition to the wiper plates 90, the wiper assembly also comprises a central wiping member 76 which forms with the wiper plates 90 a continuous wiping surface, and further within the confines of which lies the pivot axis about which the wiper carriers 88 pivot as aforesaid. In the machine in accordance with the invention, the wiper carriers 88 pivot about a common axis arranged centrally of the central wiping member 76, which is in the form of a so-called "button".

The central wiping member 76 is mounted on a support in the form of a block 81, on which also is carried an arcuate plate member 78, the center of curvature of which coincides with the common axis of the wiper carriers 88. The member 78 is accommodated in corresponding grooves 83 formed in the upper surface of each wiper carrier 88. The member 78 and grooves 83 thus constitute a groove-and-projection connection between the wiper carriers and the support for the central wiping member.

In the operation of the machine, it will be appreciated where there is a forward component of movement of the wiper carriers, this will be transmitted through the groove-and-projection connection to the central wiping member, which is thus also advanced with the wiper carriers, while purely pivotal movement of the wiper carriers about their common axis wil result in no corresponding movement of the central wiping member. Thus, when the wiper assembly is advanced under the action of the piston-and-cylinder arrangement 72, as the cam follower rolls 94 move along the first part of each section of the cam grooves 92, the central wiping member 76 will also be advanced, while as said rolls move along the second part of each groove section, the central wiping member will remain stationary. In this way, the central wiping member is always brought to the same position in relation to the operative position of the shoe support 12, when the wiper assembly is advanced, regardless of the position to which the wiper plates 90 are ultimately moved.

Figure 2:
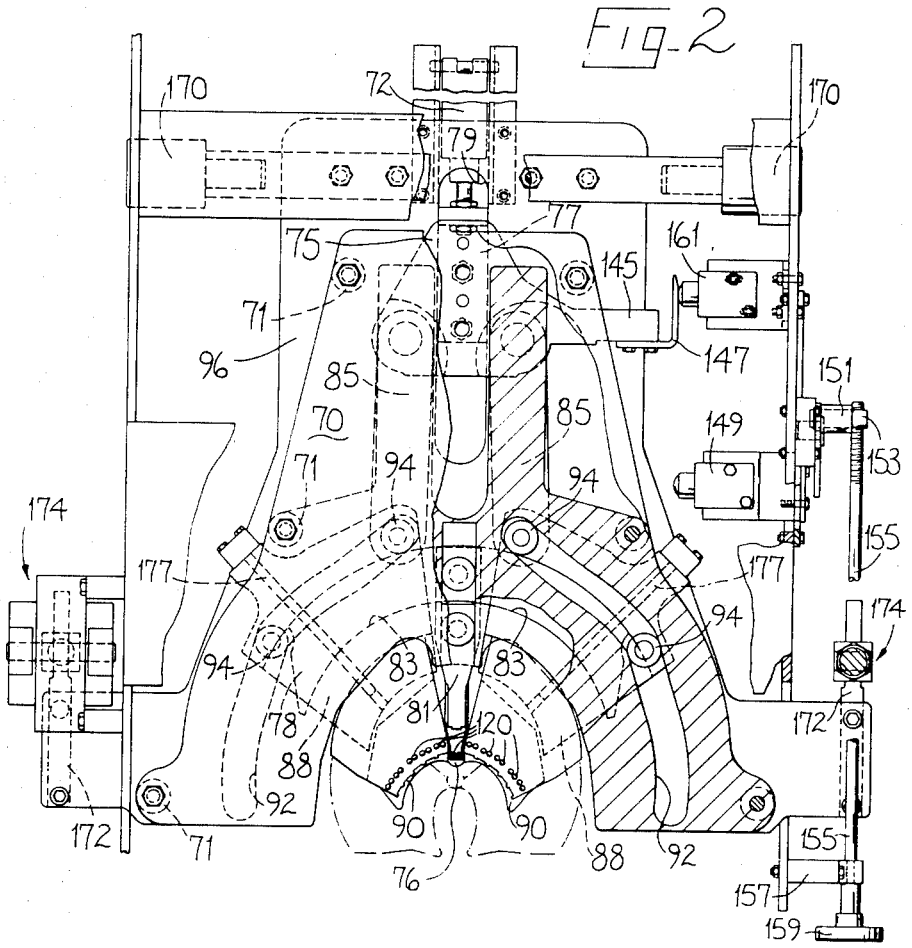
FIG. 2 is a fragmentary plan view, with parts broken away, showing details of a wiper assembly and associated parts of said machine.

As in the machine disclosed in the aforementioned specification, the central wiping member and the wiper plates 90 are provided with apertures 120 (only those in the central wiping member being shown in FIG. 2), the central wiping member having two section apertures arranged symmetrically in relation to the common axis of the wiper carriers, through which apertures nails can be driven for securing a wiped over lasting margin of the upper to the corresponding marginal portion of the insole of a shoe being operated upon. The nails inserted through the apertures formed in the central wiping member 76 are referred to as the "back tacks", and the position to which the wiper member is moved as aforesaid is referred to as the "back tack position".

The fastener-inserting means of the machine in accordance with the invention is conventional, and comprises a plurality of drivers 122 accommodated in housings 124 therefor carried by the wiper carriers 88 and the central wiping member 76. For actuating the drivers 122, a single fluid pressure operated hammer plate 126 is provided, (see FIG. 1) nail separater means generally designated 128 also being provided on the machine frame 10 for feeding nails, one at a time, via tubes 130, to the driver housing 124.

If it is desired to vary the position at which the back tacks are inserted into the shoe, since the central wiping member 76 is always brought to the same position, in the machine now being described, it is necessary to adjust the operating position of the shoe support 12 in relation to said member. To this end, the fore-and-aft position of the heel band 20 relative to wiper assembly is arranged to be variable. Such variation of the fore-and-aft position is conveniently achieved in the manner set out in the aforementioned specification, and to this end a knob 102 is provided mounted on a rotary shaft 104 which acts through a plurality of sprockets and a chain (not shown) for varying the position of a block (not shown) on which the heel band 20 is supported. Alternatively, such variation may be achieved using any suitable conventional motor and control therefor.

For varying the overall pattern of the nails inserted by the fastener-inserting means, the stroke of the piston-and-cylinder arrangement 72 can be controlled, thereby controlling also the amount of "pivotal only" movement of the wiper plates 90 about their common axis, after the central wiping member 76 has been brought to its back tack position. To this end, the plate 75 has an extention 145 carrying a bracket 147, which serves as an actuator for a valve 149 mounted on a side portion of the machine frame 10 for sliding adjustment lengthwise of the shoe bottom. For effecting sliding movement of the valve 149, abracket 151 is connected to the housing thereof, said bracket carrying a threaded member 153 which receives a rearward end of a shaft 155, a forward end of which is captive in a further bracket 157, secured to the side portion of the machine frame 10, and carries a knob 159. Thus, by rotation of the knob and thus of the shaft 155, the position of the valve 149 can be adjusted. The valve 149 and associated parts herebefore described constitute adjustable stop means of the machine. Thus, by varying the position of the valve 149, the stroke of the piston-and-cylinder arrangement 72 is adjustably controlled, and this is effective to vary the amount of movement of the wiper plates 90 under the influence of the second part of each section of the cam grooves 92, so that the pivotal movement of the wiper plates 90 can be set according to the overall pattern desired for the insertion of the fasteners.

The bracket 147 is also utilized to actuate a further valve 161, also mounted on the side portion of the main frame 10, which further valve controls the amount of rearward movement of the wiper assembly. The valve 161 is fixed to the machine frame.

In the operation of the machine, the operator first ensures that the setting of the fore-and-aft position of the heel band 20 and the position of the valve 149 are appropriate for the shoe to be operated upon, in terms of the back tack position and the overall pattern of the fasteners. He then places a shoe, bottom up on the last pin 14 and initiates a type of operation of the machine, whereupon the shoe support 12 is moved to its operative position, with the back seam region of the shoe urged against the corresponding region of the heel band 20, and the shoe is urged heightwise into engagement with the holddown 8. The heel band 20 is then closed onto the shoe, by mechanism described in the aforementioned patent specification. The piston-and-cylinder arrangement 72 is then energized, causing the wiper assembly to move forwardly, the wiper plates 90 advancing and pivoting inwardly while the central wiping member 76 is advanced only, until the rolls 94 reach the second part of the sections of the cam grooves 92, further, pivotal only movement of the wiper plates 90 then taking place to a limit determined by the valve 149. With the wiper assembly in this position, bedding pressure is applied by the wiper assembly to the shoe bottom, by actuation of the piston-and-cylinder arrangements 174, causing the base plate 96 to pivot about the axis of the bearing blocks 170. As is conventional in tack seat lasting machines, the wiper plates are heated by means of cartridge heaters 177. With bedding pressure applied, the fastener-inserting means is then actuated, and fasteners are driven, through the apertures in the leading edge portions of the wiper plates and in the central wiping member, thus to secure the wiped over and pressed lasting marginal portion of the upper to corresponding marginal portions of the insole of the shoe being operated upon. The wiper assembly is then retracted, to a limit determined by valve 161, and the shoe support 12 is returned to its initial position.

I claim:

1. A machine for lasting heel seat portions of shoes, comprising:

a shoe support for supporting, bottom uppermost, a shoe comprising an upper positioned on a last and an insole on the last bottom;

a wiper assembly, comprising a central wiping member, carried by a support therefor, and two wiper plates, each carried by a wiper carrier, said member being fixed against rotation, while said carriers are mounted for pivotal movement, each about an axis which lies within the confines of the central wiping member, the member and plates presenting a substantially continuous leading edge portion whereby lasting marginal portions of the upper of a shoe supported by the shoe support can be wiped over and pressed against corresponding marginal portions of the insole of such shoe; and fastener-inserting means, associated with the wiper assembly, whereby fasteners can be driven, through a series of apertures formed in the wiping member and wiper plates, adjacent the leading edge portion presented thereby, for securing said wiped-over lasting marginal portions of the upper to the corresponding marginal portions of the insole, two such apertures being disposed side-by-side in the central wiping member, and the fasteners driven through said apertures being the most heelwardly disposed of the fasteners inserted by the fastener-inserting means, wherein advancing means is provided whereby the support for the central wiping member and the wiper carriers can be advanced towards the shoe support, cam means also being provided whereby pivotal movement of the wiper carriers can be effected in response to operation of the advancing means, the position to which the central wiping member is advanced as aforesaid determining the location of insertion of the most heelwardly disposed fastener(s), while the amount of pivotal movement of the wiper carriers, and thus the wiper plates, determines the overall pattern in which the fasteners are inserted, characterized in that the advancing means is operatively connected to the wiper carriers, and each wiper carrier is connected to the support for the central wiping member, for relative sliding movement therebetween, by an arcuate groove-and-projection connection, the center of curvature of which coincides with the axis of said wiper carriers and in that the construction and arrangement of the cam means is such that during a first part of the operation of the advancing means the wiper carriers are advanced towards the shoe support, while in a subsequent part each carrier merely pivots about its axis.

2. A machine according to claim 1, wherein the cam means comprises, for each wiper carrier, two cam portions with which cam follower rolls co-operate, characterized in that each portion comprises a first part, which is generally inclined to the direction of advancing movement of the support for the central wiping member towards the shoe support, and a second part, which is arcuate and the center of curvature of which coincides with the axis of the wiper carrier.

3. A machine according to claim 2, characterized in that the first part of each cam portion is rectilinear.

4. A machine according to claim 3, wherein said rectilinear part is inclined to the lengthwise direction of the shoe bottom.

5. A machine according to any one of claims 2 to 4 characterized in that each cam portion is provided by a slot in a cam plate fixedly mounted in the machine, and the cam follower rolls are carried on the wiper carriers.

6. A machine according to claim 5, wherein each wiper carrier has a groove formed therein for receiving a projection carried by the support for the central wiping member.

7. A machine according to claim 6, characterized in that the wiper carriers are pivotal about a common axis, and the support for the central wiping member is provided with a single projection received in the grooves of the two wiper carriers, the center of curvature of the projection being aligned with the common axis of the wiper carriers.

8. A machine according to claim 7, characterized in that a heel band is provided whereby the heel seat of a shoe to be operated upon can be located in relation to the wiper assembly, means also being provided for adjusting the position of said heel band lenghtwise of the shoe bottom.

9. A machine according to claim 8, characterized in that the advancing means is fluid pressure operated and in that adjustable stop means is provided whereby the amount of movement of the wiper assembly can be adjusted.

* * * * *